US006068737A

United States Patent [19]

De Chamorro et al.

[11] Patent Number: 6,068,737

[45] Date of Patent: May 30, 2000

[54] SIMULTANEOUS DEMETALLIZATION AND DESULPHURATION OF CARBONACEOUS MATERIALS VIA MICROWAVES

[75] Inventors: Maria De Las Mercedes De Chamorro; Monica Cristina Romano, both of Caracas, Venezuela

[73] Assignee: Simon Bolivar University, Caracas, Venezuela

[21] Appl. No.: 08/857,599

[22] Filed: May 16, 1997

[51] Int. Cl.[7] ..... C07C 1/00; C01B 1/00; A62D 3/00; C10L 5/00

[52] U.S. Cl. ..... 204/157.15; 204/158.12; 588/225; 588/227; 44/502; 44/622; 44/624; 44/904; 210/748

[58] Field of Search ..... 204/157.15, 157.43, 204/157.49, 158.21; 44/502, 622, 624, 904; 588/225, 227; 210/748

[56] References Cited

U.S. PATENT DOCUMENTS

| | | | |
|---|---|---|---|
| 4,123,230 | 10/1978 | Kirkbride | 44/112 |
| 4,148,164 | 4/1979 | Humphrey | 52/94 |
| 4,153,533 | 5/1979 | Kirkbride | 204/157.15 |
| 4,234,402 | 11/1980 | Kirkbride | 204/162 R |
| 4,272,357 | 6/1981 | Rollman | 208/89 |
| 4,279,722 | 7/1981 | Kirkbride | 204/162 R |
| 4,303,497 | 12/1981 | Mitchell et al. | 208/10 |
| 4,306,964 | 12/1981 | Angevine | 208/210 |
| 4,408,999 | 10/1983 | Nadkarni et al. | 44/904 |
| 4,447,314 | 5/1984 | Banta | 208/89 |
| 4,508,615 | 4/1985 | Oleck et al. | 208/89 |
| 4,510,043 | 4/1985 | Oleck et al. | 208/97 |

*Primary Examiner*—Eana Wong
*Attorney, Agent, or Firm*—Pennie & Edmonds LLP

[57] ABSTRACT

The process of demetalization and desulphuration of a mixture of carbonaceous material in an acid medium subjecting the mixture to the influence of wave energy in the microwave range, recovering, afterwards, the sulphur and separating the treated material from the rich in metal liquors.

17 Claims, No Drawings

SIMULTANEOUS DEMETALLIZATION AND DESULPHURATION OF CARBONACEOUS MATERIALS VIA MICROWAVES

BACKGROUND OF THE INVENTION

This invention relates to a process for decreasing or eliminating the sulphur as well as metal content of carbonaceous materials. The presence of sulphur and metals is the main factor that limits the use of carbonaceous materials, it then becomes necessary to develop industrializable techniques that reduce or eliminate such impurities.

The development of the radar during the second world war, estimulated the accelerated process of microwave technology. Research for industrial applications began in the mid 1940's, and included the treatment of carbon in order to remove the organic matter and the sulphur, the drying of feeding pasta, and the heating of frozen food.

Microwaves are electromagnetic energy. This form of radiation consists of the oscilation of the electric and magnetic fields that are perpendicular between them. Microwave energy is, generally, an ionized radiation that when becoming absorbed causes the molecular movement generating a quick and uniform heating. As opposed to ultraviolet, visible and infrared radiations whose frequency ranges cause the excitement of the valency electrons and of the molecular vibrations, the microwave radiation only causes dipolar rotation and ionic conduction. This phenomenon explains the fact that this kind of energy does not alter or destroy the molecular structure.

Kirkbride, Chalmer in their works (U.S. Pat. Nos. 4,123,230; 4,148,164 and 4,234,402), affirm that they satisfactorily desulphurate samples of bituminous carbon, previously crushed and dried, in contact with hydrogen at high pressures in a reactor of fluidizied bed. In a futuristic vision, Kirkbride patented, also in 1981 (U.S. Pat. No. 4,279,722) the use of microwaves in operations of petroleum refinement, given the fact that they would be working in operative conditions of less severity and in a shorter time span, therefore increasing the revenues and diminishing the costs.

Up to the present, the techniques proposed for the simultaneous demetallization and desulphuration suggest the catalytic hydrotreatment of heavy fractions of crude (U.S. Pat. Nos. 4,306,964; 4,447,314; 4,508,615; 4,510,043), or treating them with hydrogenic solvents in the presence of catalysts (U.S. Pat. Nos. 4,272,357 and 4,303,497). The process proposed on this patent, as oppossed to the processes previously mentioned, does not require severe conditions or catalysts, it is applicable to any carbonaceous material, the time of exposure is less than an hour, the percentages of extraction of sulphur as well as of metals are high, and it does not destroy the carbonic matrix of the material.

The objective of this invention is the simultaneous demetallization and desulphuration of carbonaceous materials using the advantages that microwave radiation offers over the methods of conventional heating.

DETAILED DESCRIPTION OF THE INVENTION

The process of this invention involves the following steps:

1.—The selection of the carbonaceous material that will be treated which could be found among the groups: crude oil and its fractions, cokes, mineral carbons, and bituminous sands. In the case of solid materials, particles of at least 5 $\mu$m will be treated, and in the case of hydrocarbons, materials that exceed the 6° API will be treated.

2.—The carbonaceous material should be placed in a reactor in contact with an acid solution in a way that the mass ratio of the mass of the carbonaceous material to the volume of the acid solution is between 0.001 and 5. The acid solution could comprise the acids $HNO_3$, $H_2SO_4$, HCL, $HCLO_4$, $H_3PO_4$, HF or the mix of any of them, in a concentrated solution or in a 50% dilution.

3.—The established mass ratio material/volume of acid solution, should be exposed to microwave radiation,from 300 to 30000 Mhz, in some materials it may be advantageous to use two or three or even more frequencies simultaneously or consecutively, for a period of time between 10 sec and 1 hour. The process could take place, with good results, at atmospheric pressure, nevertheless, it is recommended to make the digestion at pressures that do not exceed 200 psig, preferably at a pressure that is above atomspheric to a maximum of 200 psig, preferably at a pressure that is above atmospheric to a maximum of 200 psig, in order to reflux and avoid the loss due to evaporation of the acid solution. For the treatment of solid carboniferous materials, the temperatures of reaction will be equivalent to the boiling temperature of the acid solution employed ±10° C. preferably greater than the boiling point of the acid solution, and its minimum volume should be greater or equal to the volume of the pore that corresponds to the material.

4.—The recovery of the sulphur, the separation of the treated carbonaceous material from the rich in metal liquors, with metal recovery and acid recycle to the reactor.

EXAMPLE 1

In the following example we wish to show the effect that the variable of granulometry has over the percentages of extraction. Coke from crude oil was employed whose caracterization is shown in Table 1, and from this coke two portions with different particle sizes were taken, greater than 500 microns, and smaller than 250 microns. The conditions for operation were: the relation, mass of the coke volume of the acid mix, was equal to 0.2, concentrated acid solution $HNO_3$—HCL 2:1, pressure 100 psig, frequency of the microwave 2450 Mhz, and time of irradiation 15 min.

TABLE 1

Characterization of the Coke of Crude Oil

| PROPERTIES | VALUES (% pp) |
|---|---|
| Humidity | 1.7 ± 0.1 |
| Ashes | 0.87 ± 0.05 |
| Volatile Matter | 13.5 ± 0.2 |
| Sulphur | 4.7 ± 01 |
| Nickel | 0.004 ± 0.001 |
| Vanadium | 0.184 ± 0.002 |

The percentages of extraction of the nickel, vanadium and sulphur from the coke delayed for both granulometries are reported in table 2 in which we can appreciate that to a lower granulometry the percentages of demetallization and desulphuration are higher than 40%.

TABLE 2

Percentages of Extraction of Nickel, Vanadium and Sulphur for two granulometries of Crude's Coke.

| | PERCENTAGES OF EXTRACTION (% pp) | | |
|---|---|---|---|
| COKE | Ni | V | S |
| C1 < 25O $\mu$m | 80 | 99 | 55 |
| C2 > 500 $\mu$m | 43 | 62 | 32 |

EXAMPLE 2

This example shows the effect that the variable of exposure time to the microwave radiation has over the percentages of extraction. Under the same conditions of operation and using the same carbonaceous material from example 1 with granulometry smaller than 250 μm, the acid digestion via microwaves took place for a time of 5, 10 and 15 min. Table 3 reports the percentages of nickel, vanadium and sulphur extracted in the three time intervals and it shows that for a longer period of time the percentages of extraction are higher.

TABLE 3

Percentages of Extraction of Nickel, Vanadium and Sulphur for Crude's Coke smaller than 250 microns at Different Times of Irradiation

| TIME OF IRRADIATION (min) | PERCENTAGES OF EXTRACTION (% pp) Ni | V | S |
|---|---|---|---|
| 5 | 43 | 80 | 35 |
| 10 | 59 | 90 | 47 |
| 15 | 80 | 99 | 55 |

What is claimed is:

1. A process for simultaneous demetallization and desulphuration of both inorganic and organic matter from a carbonaceous material which comprises:

contacting said carbonaceous material with an acid solution to form an acidified carbonaceous material;

exposing the acidified carbonaceous material to microwave radiation of a sufficient quantity, under a pressure that is above atmospheric to a maximum of 200 psig, and for a sufficient time to simultaneously extract organic compounds that contain sulphur and metals from the acidified carbonaceous material without destroying the carbonaceous material to form a treated carbonaceous material; and recovering sulphur and one or more metals from the extracted organic compounds of the treated carbonaceous material.

2. The process according to claim 1, in which the carbonaceous material is selected from the group consisting of crude oil and its fractions, cokes, mineral carbons, and bituminous sands.

3. The process according to claim 1, in which the carbonaceous material has a particle size of at least 5 μm.

4. The process according to claim 3, in which the carbonaceous material is treated with a volume of the acid solution in an amount which is greater than the pore volume of the carbonaceous material.

5. The process according to claim 1, wherein the acid of the acid solution is selected from the group consisting of $HNO_3$, $H_2SO_4$, HCl, $HClO_4$, $H_3PO_4$, HF or mixtures thereof.

6. The process according to claim 5, wherein the mass ratio of the carbonaceous material to the acid solution is between 0.001 and 5.

7. The process according to claim 5, wherein the acid solution is concentrated.

8. The process according to claim 1, in which the microwave radiation has a frequency in the range of between 300 and 30,000 Mhz.

9. The process according to claim 8, wherein the acidified carbonaceous material is exposed simultaneously to microwave radiation having more than one frequency.

10. The process according to claim 1, in which the acidified carbonaceous material is exposed to the microwave radiation for between about 10 seconds and 1 hour.

11. The process according to claim 1, wherein the acidified carbonaceous material is exposed to the microwave radiation for a period of time which obtains a percentage of demetalization and desulphuration which is greater than 40%.

12. The process according to claim 1, in which the acidified carbonaceous material is exposed to the microwave radiation at a temperature which is greater than the boiling point of the acid solution.

13. The process according to claim 1, wherein the step of recovering sulphur and one or more metals from the extracted organic compounds further comprises recovering a metal rich liquor from the treated carbonaceous material, recovering one or more metals from the metal rich liquor to form a metal depleted acidic solution, and recycling the metal depleted acidic solution for use as part of the acid solution that contacts the carbonaceous material.

14. The process according to claim 13, wherein the metal rich liquor includes at least vanadium and nickel.

15. The process of claim 1 wherein the acidified carbonaceous material is exposed to the microwave radiation for at least 5 minutes.

16. A process for simultaneous demetallization and desulphuration of both inorganic and organic matter from a carbonaceous material, wherein said carbonaceous material is a crude oil that exceeds 6° API, which comprises:

contacting said carbonaceous material with an acid solution to form an acidified carbonaceous material;

exposing the acidified carbonaceous material to microwave radiation of a sufficient quantity and for a sufficient time to simultaneously extract organic compounds that contain sulphur and metals from the acidified carbonaceous material without destroying the carbonaceous material to form a treated carbonaceous material; and recovering sulphur and one or more metals from the extracted organic compounds of the treated carbonaceous material.

17. A process for simultaneous demetallization and desulphuration of both inorganic and organic matter from a carbonaceous material which comprises:

contacting said carbonaceous material with an acid solution to form an acidified carbonaceous material;

exposing the acidified carbonaceous material to microwave radiation of a sufficient quantity and for a sufficient time to simultaneously extract organic compounds that contain sulphur and metals from the acidified carbonaceous material without destroying the carbonaceous material to form a treated carbonaceous material;

maintaining a constant reflux of the carbonaceous material and acid solution while the acidified carbonaceous material is exposed to the microwave radiation; and recovering sulphur and one or more metals from the extracted organic compounds of the treated carbonaceous material.

* * * * *